US005174456A

United States Patent [19]

Grody

[11] Patent Number: 5,174,456

[45] Date of Patent: Dec. 29, 1992

[54] SHELL DOOR LOCKING DEVICE

[76] Inventor: Steven Grody, 427 Colyton St. #205, Los Angeles, Calif. 90013

[21] Appl. No.: 868,476

[22] Filed: Apr. 14, 1992

Related U.S. Application Data

[62] Division of Ser. No. 707,698, May 30, 1991.

[51] Int. Cl.[5] ..... E05C 19/18

[52] U.S. Cl. ..... 292/288; 292/258; 292/339; 292/DIG. 43

[58] Field of Search ..... 292/288, 289, 294, 305, 292/339, 338, 258, DIG. 43; 16/66, 84; 267/64.12

[56] References Cited

U.S. PATENT DOCUMENTS

| | | | |
|---|---|---|---|
| 1,858,804 | 5/1932 | Carlson | 292/36 |
| 2,048,377 | 7/1936 | Robinson | 292/36 |
| 2,375,837 | 5/1945 | Buehner . | |
| 2,628,117 | 2/1953 | Robinson | 292/36 |
| 3,977,712 | 8/1976 | Northrop | 16/84 |
| 4,079,479 | 3/1978 | Clement | 16/66 |
| 4,641,865 | 2/1987 | Pastva | 292/5 |
| 4,695,083 | 9/1987 | Herrmeyer . | |
| 4,715,650 | 12/1987 | Berman et al. | 403/100 |
| 4,728,131 | 3/1988 | Burns | 292/7 |
| 4,819,461 | 4/1989 | Pearson | 292/DIG. 43 |
| 4,898,408 | 2/1990 | Hauber . | |
| 4,899,420 | 2/1990 | Bye et al. | 16/66 |
| 4,966,018 | 10/1990 | Hauber | 70/708 |
| 4,973,097 | 11/1990 | Nosan et al. | 292/338 |
| 5,024,303 | 6/1991 | Kosloff | 292/DIG. 43 |
| 5,072,978 | 12/1991 | Woodward | 292/359 |

*Primary Examiner*—Eric K. Nicholson

*Attorney, Agent, or Firm*—Spensley Horn Jubas & Lubitz

[57] ABSTRACT

Methods and devices for locking the door or flap of a typical pick-up truck shell closed from the interior of the shell employ a substantially rigid member which is selectively secured to moving parts of the existing latch mechanism to prohibit such moving parts from moving and, to, thereby, selectively prohibit the latch mechanism from unlatching or unlocking the door or flap of the shell. In order to lock the shell door or flap, the substantially rigid member is abutted against and secured to moving parts of the latch mechanism from the interior of the shell. In this manner, a person inside of the shell and pick-up bed may secure the flap or door in a closed position and prohibit the flap or door from being opened by prohibiting movement of the moving parts of the latch mechanism.

7 Claims, 7 Drawing Sheets

SHELL DOOR LOCKING DEVICE

This is a division of application Ser. No. 707,698, filed on May 30, 1991.

BACKGROUND OF THE INVENTION

1. Field of the Invention

The present invention relates to a shell locking device and, more specifically to a device for locking the door of a pick-up truck bed shell disposed, e.g., over the bed of a pick-up truck, from the interior of the shell.

2. Related Art

Various types of pick-up truck bed shell devices which fit over the bed of a pick-up truck have been known for quite some time. Such shell devices are typically attached to the side walls of the bed of a pick-up truck by bolts, brackets or other well known mechanisms.

Such shell devices typically include a hinged door or flap which may be opened and closed to selectively provide access or restrict access to the interior of the camper shell and pick-up truck bed. Such shell devices also typically include a latch mechanism which allows a user to latch the door or flap closed from the outside of the shell and pick-up truck bed. Many of these latch devices include a locking mechanism, such as a key lock, which allows a user to lock the door or flap closed from the outside of the shell or pick-up truck bed.

Many pick-up truck shell owners use the pick-up truck bed and shell to hold people, e.g. for transportation, sleeping, camping, etc. However, the pick-up truck shell devices known to the inventor do not allow a person inside of the shell and pick-up truck bed to lock the door or flap of the shell closed from the interior of the shell or bed. Recognizing the deficiencies of such known shell devices and latching mechanisms, the inventor has designed a unique device which allows a person inside of the shell or pick-up truck bed to readily lock and unlock the door or flap of a typical shell, e.g., for security or safety reasons.

SUMMARY OF THE INVENTION

The present invention relates to methods and devices for locking the door or flap of a typical pick-up truck shell closed from the interior of the shell. Embodiments of the invention employ a substantially rigid member which is selectively secured to moving parts of the existing latch mechanism to prohibit such moving parts from moving and, to, thereby, selectively prohibit the latch mechanism from unlatching or unlocking the door or flap of the shell. In order to lock the shell door or flap, the substantially rigid member is abutted against and secured to moving parts of the latch mechanism from the interior of the shell. In this manner, a person inside of the shell and pick-up bed may secure the flap or door in a closed position and prohibit the flap or door from being opened by prohibiting movement of the moving parts of the latch mechanism. Embodiments employ a rigid member that operates as a keyless lock which makes it virtually impossible for one inside of the shell to lock the flap or door without the ability to unlock the flap or door from inside the shell.

A first embodiment of the invention is designed to operate with an existing shell door or flap latching mechanism of the type having a rotatable cam and at least one movable arm. In the first embodiment of the invention, a substantially rigid member is provided with a cam receiving portion for receiving the rotatable cam of an existing latch mechanism. The rigid member also includes a rigid arm which extends adjacent and secures to the moving arm of the existing latch mechanism. When the substantially rigid is secured to the existing latch mechanism, the cam receiving portion receives the rotatable cam of the latch mechanism while the arm portion secures to the movable arm of the existing latch mechanism. By virtue of its rigidity, the rigid member prohibits the rotation of the cam mechanism and thus prohibits the movement of the arm of the latch mechanism to, thereby, prohibit the latch mechanism from unlatching or unlocking the door or flap of the shell.

A second embodiment of the invention is designed to operate with an existing shell door or flap latching mechanism of the type having a rotatable cam and two movable arms. In the second embodiment, the substantially rigid member comprises a cam receiving portion and two substantially rigid arms extending from the cam receiving portion. According to the second embodiment, the cam of the existing latch mechanism is received by the cam receiving portion while the two arms of the existing latch mechanism are received by the two respective rigid arms of the substantially rigid member. By virtue of its rigidity, the rigid member prohibits the rotation of the cam mechanism and thus prohibits the movement of the arm of the latch mechanism to, thereby, prohibit the latch mechanism from unlatching or unlocking the door or flap of the shell.

A third embodiment of the invention is designed to operate with an existing shell door or flap latching mechanism of the type having a movable arm. In the third embodiment of the invention, a substantially rigid member comprises an elongated member having a slot provided at each end. A slot is provided at a first end of the substantially rigid member for receiving the movable arm of an existing latch mechanism. A slot provided at the second end of the substantially rigid member is provided for receiving a portion, e.g. a bolt, of an existing strut mechanism of the existing door or flap of the shell. By virtue of its rigidity, the substantially rigid member prohibits movement of the latch arm with respect to the strut, and, thereby, prohibits the latch arm from unlatching or unlocking the door or flap from its closed position.

A fourth embodiment of the invention is designed to operate with an existing shell door or flap of the type having a pivotable handle and a movable arm. In the fourth embodiment of the invention, a substantially rigid member is provided with a handle receiving portion for receiving the pivotable handle of an existing latch mechanism. The substantially rigid member also includes a rigid arm which extends adjacent to and secures to the movable arm of the existing latch mechanism. When the substantially rigid member is secured to the existing latch mechanism, the handle receiving portion receives the pivotable handle while the rigid arm secures to the movable arm of the existing latch mechanism. By virtue of its rigidity, the rigid member prohibits pivotal motion of the handle and restricts movement of the arm of the latch mechanism to, thereby, prohibit the latch mechanism from unlatching or unlocking the door or flap of the shell.

BRIEF DESCRIPTION OF THE DRAWINGS

The detailed description of embodiments of the invention will be made with reference to the accompanying drawings, wherein like numerals designate corresponding parts in the several figures.

DESCRIPTION OF THE PREFERRED EMBODIMENTS

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 1:
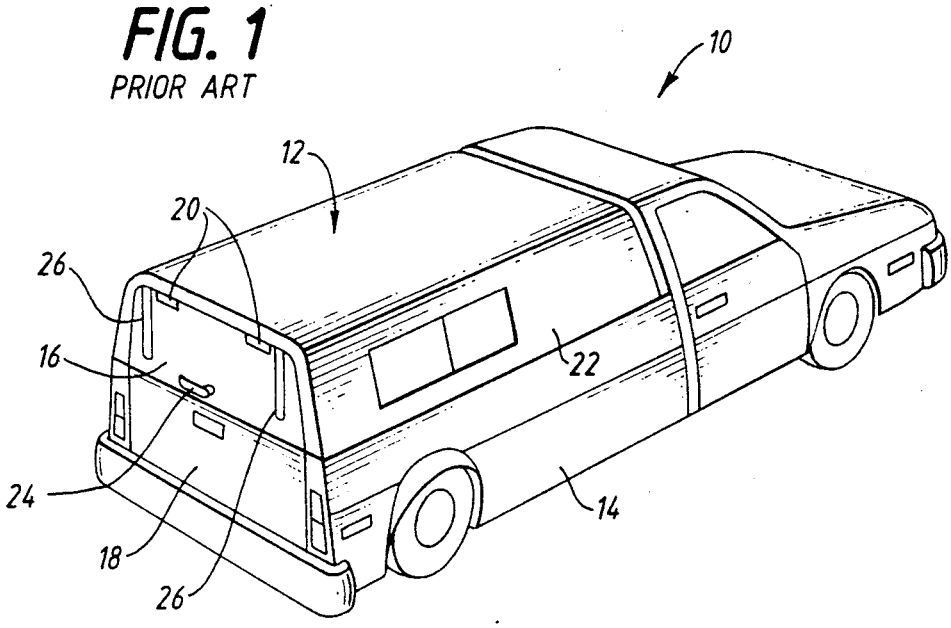
FIG. 1 PRIOR ART
FIG. 1 is a perspective view of a conventional pick-up truck and a conventional pick-up truck shell arranged over the bed of the pick-up, truck.

The present invention relates to methods and devices for locking the door or flap of a typical pick-up truck shell closed from the interior of the shell. FIG. 1 shows a conventional pick-up truck 10 with a conventional pick-up truck shell 12 arranged over the bed 14 of the truck. The illustrated shell 12 has a door or flap 16 disposed over the tailgate 18 of truck 10. Door 16 is hinged at hinges 20 to the main body 22 of shell 12.

A handle 24 rotates to operate a latch mechanism (not shown in FIG. 1) for selectively latching door 16 in a closed position to the main body 22 of shell 12. When door 16 is in a closed position, handle 24 may be rotated to operate the latch mechanism to unlatch the door. When unlatched, door 16 is free to open by pivoting about hinges 20. Some shells are provided with pneumatic struts 26 which automatically push door 16 open when the door is unlatched.

It is commonly known to provide handle 24 with a key operated lock operable from the exterior of shell 12. The lock operates by selectively locking handle 24 in a fixed position to lock the door 16 in a closed and latched position. Prior latching mechanisms known to the inventor, however, do not provide means for locking and unlocking the door of the shell from the interior of the shell. Some known latching mechanisms do not even provide a handle which can be operated from the interior of the shell.

As a result, a person inside of shell 12 cannot lock the door 16 and, in some cases, cannot unlatch the door 16 without assistance from someone outside of the shell. Thus, it is often the case that the door 16 is left unlatched and/or unlocked any time a person is inside of the shell. Furthermore, when left unlatched, the doors on those shell designs which are provided with pneumatic struts will be automatically pushed into an open position. Such known shell and latching mechanism designs lead to various unsafe practices, such as transporting people inside of the shell with the shell door wide open or with the shell door latched closed without means for opening the door from inside the shell. Additionally, such shell designs do not allow a person to selectively lock and unlock the door from the interior of the shell, e.g., for security while sleeping or camping in the shell interior.

Recognizing the deficiencies of such known shell devices and latching mechanisms, the inventor has designed unique devices and methods which allow a person inside of the shell or pick-up truck bed to readily lock and unlock the door or flap of a typical shell, e.g., for security or safety reasons. Embodiments of the present invention provide a handle which allows a person inside of the shell to unlatch the door or flap once the door or flap is unlocked. Embodiments of the present invention are discussed below in conjunction with examples of various conventional shell door latching mechanisms with which the embodiments may operate.

Figure 2:
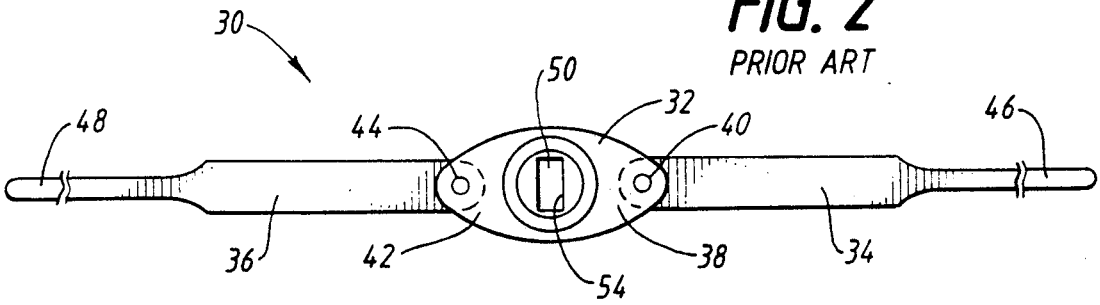
FIG. 2 PRIOR ART
FIG. 2 and 3 are schematic views of a first type of shell door or flap latching mechanism commonly used on existing pick-up truck bed shells.
Figure 3:
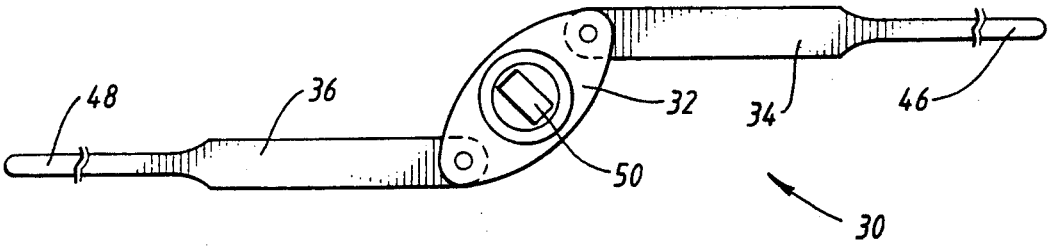
FIG. 3 PRIOR ART

FIGS. 2 and 3 show a first type of shell door or flap latching mechanism which is commonly used on existing shells. The views shown in FIGS. 2 and 3 are views which would be seen from the interior of the shell when the shell door is closed. FIG. 2 shows the position of the latching mechanism when the door of the shell is latched, while FIG. 3 shows the position of the latching mechanism when the shell door is unlatched. Typically, the latching mechanism shown in FIGS. 2 and 3 is mounted adjacent the lower edge of the door or flap. However, it is contemplated that the present invention may be employed with a similar latching mechanism mounted in another location.

Referring to FIG. 2, the latching mechanism 30 includes a centrally located cam portion 32 and two horizontally extending arms 34 and 36, respectively. Cam portion 32 has a first flange portion 38 to which arm 34 is pivotally connected via a pivotal connector 40, such as a rivet, a bolt, or the like. Cam portion 32 also includes a second flange portion 42 to which arm 36 is pivotally connected via a similar pivotal connector 44.

Cam portion 32 shown in FIGS. 2 and 3 is oval shaped. However, it is contemplated that embodiments of the present invention can be employed with latching mechanisms having cam portions of various other geometric shapes. Each arm 34 and 36, respectively, is composed of a substantially rigid bar extending from cam portion 32 to a free end 46 and 48, respectively. In the latched position (FIG. 2), each of the free ends 46 and 48 of arms 34 and 36, respectively, are extended to engage with an aperture (not shown) or a stop bracket (not shown) provided on the shell body 22 and to, thereby, prohibit door 16 from being opened. In the unlatched position (FIG. 3), the free ends 46 and 48 are retracted so as to be disengaged with the apertures or stop brackets and to, thereby, allow the door to be opened.

Latching mechanism 30 further includes a rotatable shaft 50 (best shown in FIGS. 2 and 5) which is connected through the shell door 16 to handle 24 (FIG. 1) disposed on the exterior of shell 12. Shaft 50 extends, on the interior of shell 12, through a bushing 52. Bushing 52 is fixed to a central location of cam portion 32. As shown in FIG. 2, shaft 50 may have a square cross section (however, latching mechanisms having shafts with other geometrically shaped cross sections may be applicable with the present invention). Shaft 50 extends through an aperture 54 in bushing 52. Aperture 54 has a shape corresponding to the cross-sectional shape of shaft 50 (in FIG. 2 this shape is a square).

As handle 24 is pivoted from the exterior of shell 12, shaft 50 is caused to rotate about its axis. Rotation of shaft 50 causes bushing 52 and, thus, cam portion 32 to rotate. Rotation of cam portion 32 in the counter-clockwise direction, as viewed from the interior of shell 12, causes pivotal connector 40 to move upward with respect to FIG. 2 and partially around the axis of shaft 50 while, at the same time, causes pivotal connector 44 to move downward with respect to FIG. 2 and partially around the axis of shaft 50. As a result of such rotational motion of cam portion 32, latching mechanism 30 shown in the latching position in FIG. 2 will be moved to the unlatching position shown in FIG. 3.

Accordingly, the pivotal motion of handle 24 affects a motion of cam portion 32 and arms 34 and 36 from one of a latching or unlatching position to the other of the latching or unlatching positions. However, as discussed above, handle 24 is disposed on the exterior of shell 12. Typically, no handle is provided on the interior of shell 12. Many of those types of latching mechanisms which do provide a handle on the interior of shell 12, in the inventors experience, do not include a mechanism for locking the latching mechanism 30 (and prohibiting the latching mechanism 30 from moving from a latching position to an unlatching position) from the interior of shell 12.

Figure 4:
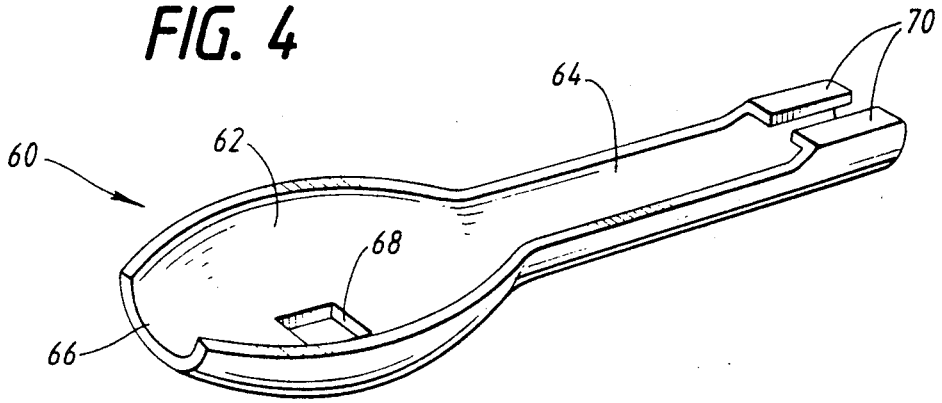
FIG. 4 is perspective view of a substantially rigid member according to a first embodiment of the invention.

First Embodiment:

FIG. 4 is a perspective view of a first embodiment of the present invention operable with a latching mechanism of the type discussed above with respect to FIGS. 2 and 3. However, it will be understood that the first embodiment may be used in conjunction with suitable shell door latching mechanisms other than the latching mechanism specifically shown in FIGS. 2 and 3.

FIG. 4 shows a substantially rigid member 60 which is composed of a cup shaped cam receiving portion 62 and an elongated arm receiving portion 64. Cam receiving portion 62 comprises a hollow semi-spherical member. Arm receiving portion 64 comprises a hollow semi-cylindrical member extending from the hollow semi-spherical member of cam receiving portion 62. Preferably, cam receiving portion 62 and arm receiving portion 64 are molded to closely correspond to the shape of cam 32, arm 34, and the portion of cam 32 which connects to arm 34. A notch 66 is provided in cam receiving portion 62, opposite to the location at which arm receiving portion 64 extends. Preferably, rigid member 60 is made of an integral, one piece structure composed of a material having suitable rigidity and strength, such as metal (including aluminum, cast iron, steel or the like). However, rigid member 60 can be composed of other materials, including polymers, wood, or the like. As is readily apparent, rigid member 60 is relatively simple in structure, includes no moving parts and can be manufactured at a relatively low cost.

Figure 5:
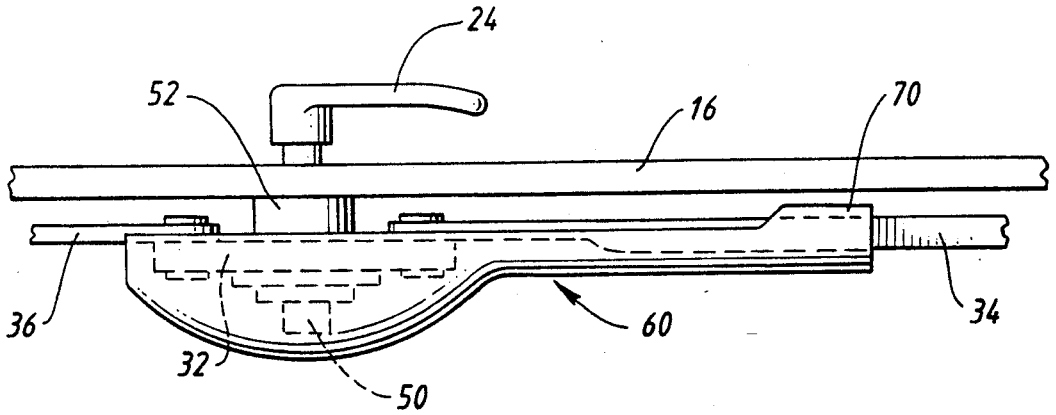
FIG. 5 is a perspective view of the substantially rigid member shown in FIG. 4 as applied to a latch mechanism as shown in FIG. 2.

In operation, when latching mechanism 30 is in the latched position (FIG. 2), rigid member 60 is placed over cam portion 32 and one of the arms 34 or 36 (as shown in FIG. 5). One arm (e.g., arm 36) extends through notch 66 upon the rigid member 60 being placed on latching mechanism 30 as shown in FIG. 5. The other flange portion (e.g., the first flange portion 38) extends within the hollow interior of cam receiving portion 62.

Optionally, an aperture 68 may be provided in cam receiving portion 62. As shown in FIG. 5, an end of shaft 50 extends through aperture 68 upon rigid member 60 being placed on latching mechanism 30 (Alternatively, the cup shape of cam receiving portion 62 may be deep enough to accommodate the end of shaft 50 without requiring shaft 50 to extend through an aperture). Preferably, aperture 68 is shaped to correspond with the outer peripheral shape of shaft 50 (square shaped in the illustrated embodiment).

Arm receiving portion 64 extends along a length of arm 34 upon rigid member 60 being placed on latching mechanism 30. As shown in FIG. 5, a portion of arm 34 extends within the hollow interior of arm receiving portion 64. In a preferred embodiment, arm receiving portion 64 includes lips 70 which partially extend around arm 34 so as to further secure rigid member 60 in place on latching mechanism 30, as shown in FIG. 5.

Upon placing rigid member 60 on latching mechanism 30, as described above and as shown in FIG. 5, the rotation of cam portion 32 and of shaft 50, and thus pivotal motion of handle 24, will be prohibited. This is due to the fact that any rotation of cam portion 32 or shaft 50 would urge rigid member 60 to pivot about the axis of shaft 50 and due to the fact that such pivotal motion of rigid member 60 is prohibited by the connection of arm portion 64 to arm 34 in conjunction with the rigidity of rigid member 60.

In operation, rigid member 60 is employed to readily lock latching mechanism 30 in the latched position (FIG. 2) by placing latching mechanism 30 in the latched position and then placing rigid member 60 over latching mechanism 30 (as shown in FIG. 5) from the interior of shell 12. Latching mechanism 30 can be readily unlocked and thus be free to move from the latched position (FIG. 2) to the unlatched position (FIG. 3) merely by removing rigid member 60 from the latching mechanism 30.

Furthermore, rigid member 60 can be used as a handle for rotating shaft 50 (to move latching mechanism 30 between a latched and unlatched position) from the interior of shell 12. This can be accomplished by placing the convex surface of cam receiving portion 62 adjacent the end of shaft 50 extending into the interior of shell 12 and by inserting the end of shaft 50 through aperture 68. Arm receiving portion 64 of rigid member 60 can then be used as a handle for pivoting rigid member 60 about the axis of shaft 50 and, by virtue of shaft 50 passing through aperture 68, causing shaft 50 to rotate. Rotation of shaft 50 will affect a movement of latching mechanism 30 between the latched and unlatched positions. Alternatively, aperture 68 may be provided as a relatively large opening (similar to the opening of cam receiving portion 78 shown in the FIG. 6 embodiment) so as to allow an existing handle (not shown) extending from shaft 50 on the interior of shell 12 to pass through rigid member 60.

Figure 6:
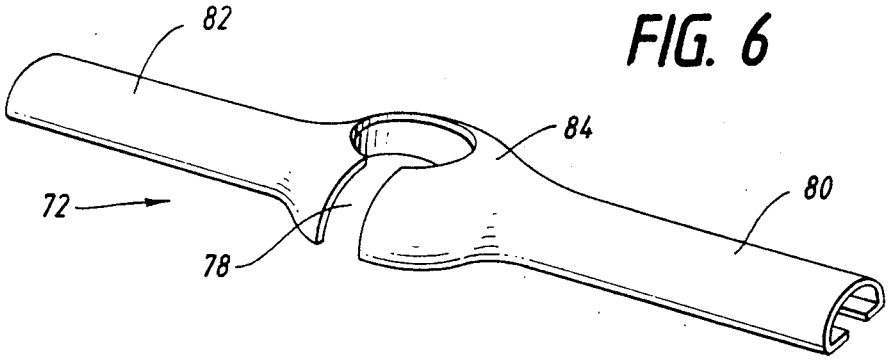
FIG. 6 is a perspective view of a substantially rigid member according to a second embodiment of the invention.
Figure 7:
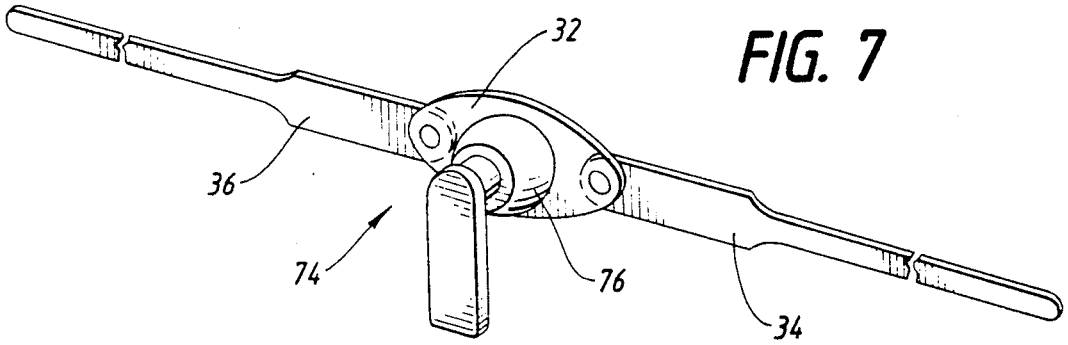
FIG. 7 is a perspective view of another type of shell door or flap latching mechanism commonly used on existing pick-up truck bed shells.
Figure 8:
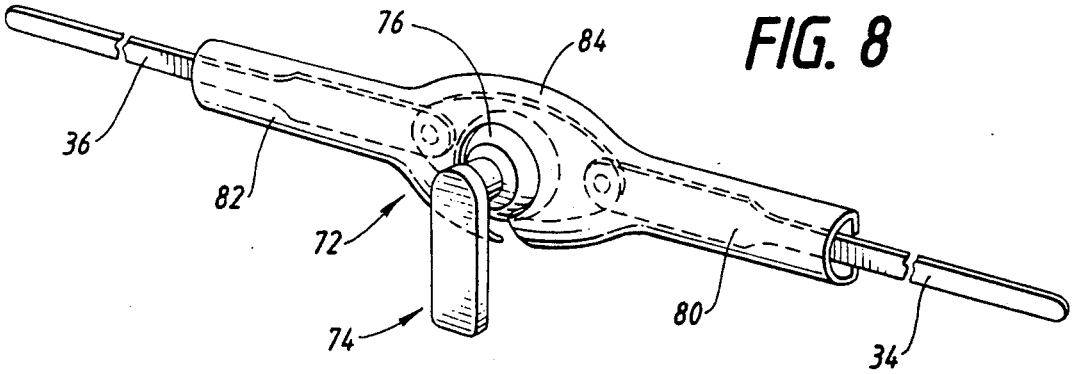
FIG. 8 is a perspective view of the substantially rigid member shown in FIG. 6 as applied to a latch mechanism as shown in FIG. 7.

Second Embodiment:

FIG. 6 shows a rigid member 72 according to a second embodiment of the present invention operable with a latching mechanism of the type shown in FIGS. 7 and 8. However, it will be understood that the second embodiment may be used in conjunction with suitable shell door latching mechanisms other than the latching mechanism specifically shown in FIGS. 7 and 8.

FIG. 7 shows a latching mechanism 74 similar in structure to latching mechanism 30 discussed above with respect to FIGS. 2 and 3. However, unlike latching mechanism 30, the latching mechanism 74 includes a bulbous structure 76 (e.g., a handle) extending from and centrally located on cam portion 32.

Rigid member 72 includes a cam receiving portion 78, a first elongated arm receiving portion 80 and a second elongated arm receiving portion 82. As an alternative embodiment, rigid member 72 includes cam receiving portion 78 and only one elongated arm receiving portion (e.g. first elongated arm receiving portion 80). Cam receiving portion 78 comprises a generally U-shaped member 84. First arm receiving portion 80 extends from a first leg of U-shaped member 84 while second arm receiving portion 82 extends from the other leg of U-shaped member 84. Preferably, U-shaped member 84 and first and second arm receiving portions 80 and 82 comprise an integral unitary member composed of a substantially rigid material, such as the materials discussed above with respect to the first embodiment. Each arm receiving portion 80 and 84 is similar to the arm receiving portion 64 discussed above with respect to the first embodiment.

FIG. 8 shows the substantially rigid member 72 placed on a latching mechanism 74 as viewed from the interior of shell 12. As shown in FIG. 7, when rigid member 72 is placed over latching mechanism 74, bulbous structure 76 passes between the legs of the U-shaped member 84. As further shown in FIG. 7, each arm of latching mechanism 74 is received by a respective arm receiving portion 80 and 82 of rigid member 72 in a manner similar to that discussed above with respect to arm receiving portion 64 of the FIG. 4 embodiment. When placed over latching mechanism 74 in a latched position, rigid member 72 prohibits the movement of the arms of latching mechanism 74 from moving to an unlatched position, by virtue of the connection of the arm receiving portions 80 and 82 to the arms of latching mechanism 74 and by virtue of the rigidity of rigid member 72.

In an alternative embodiment, rigid member 60 of FIG. 4 may be provided with a cam receiving portion 62 having a size and shape suitable to receive bulbous structure 76. In this manner, the first embodiment shown in FIG. 4 may be employed with a latching mechanism as shown in FIG. 7.

Figure 9A:
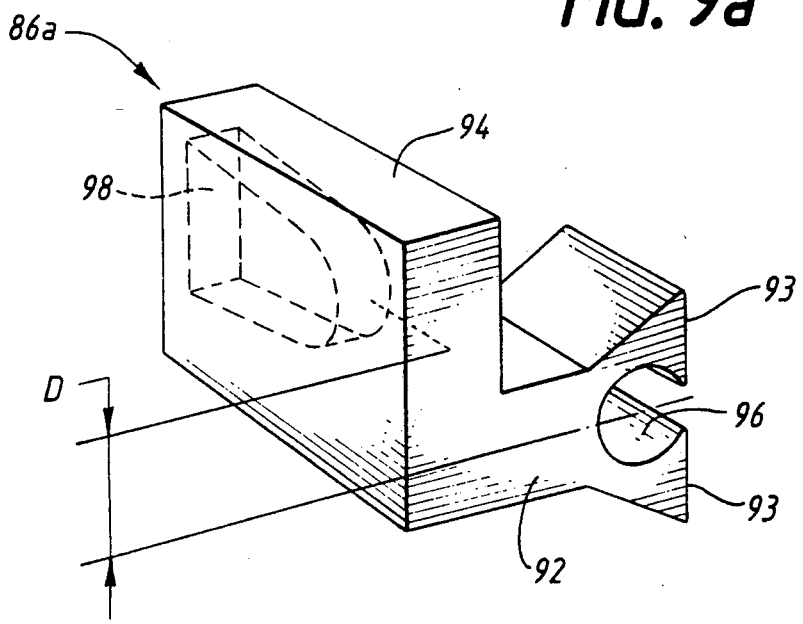
FIG. 9*a* is a perspective view of a substantially rigid member according to a third embodiment of the present invention.
Figure 10:
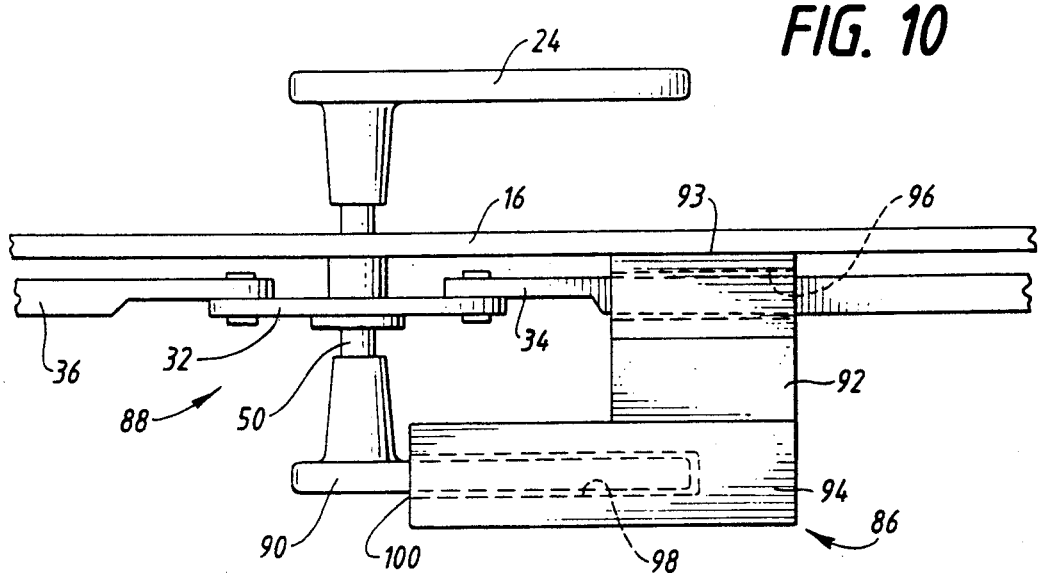
FIG. 10 is a schematic view of another type of shell door or flap latching mechanism commonly used in known pick-up truck bed shells with a substantially rigid member as shown in FIG. 9*a* or 9*b* applied thereto.
Figure 11:
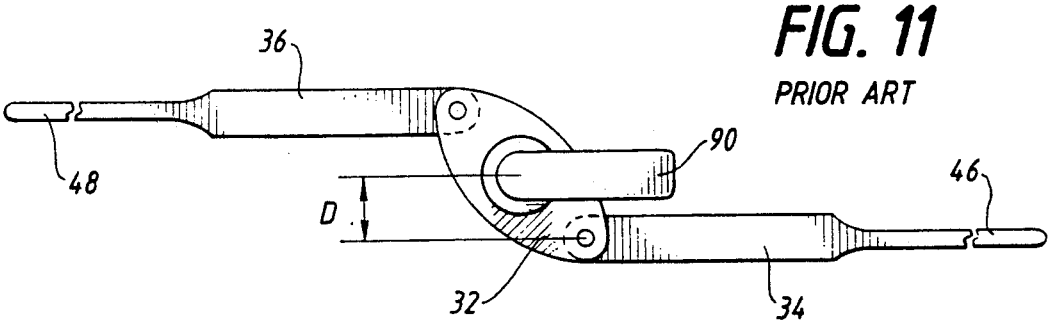
FIG. 11 PRIOR ART
FIGS. 11 and 12 are schematic views of the latching mechanism shown in FIG. 10, in a latched and an unlatched position, respectively.
Figure 12:
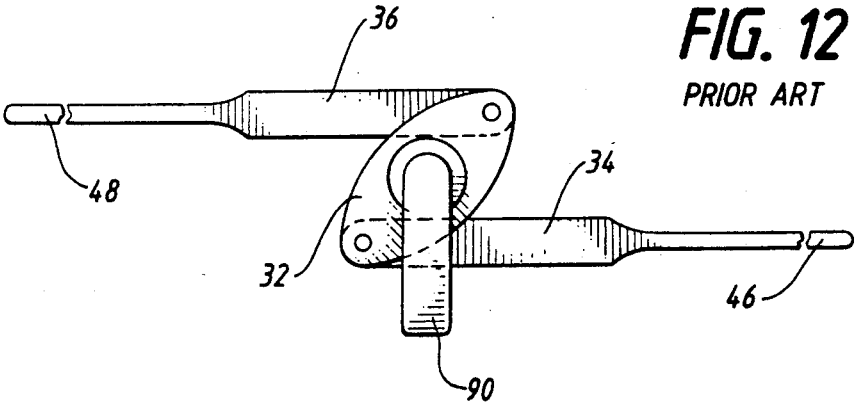
FIG. 12 PRIOR ART

Third And Fourth Embodiments:

FIG. 9*a* shows a substantially rigid member 86*a* according to a third embodiment of the present invention operable with a latching mechanism 88 of the type shown in FIGS. 10, 11 and 12. However, it will be understood that the third embodiment may be used in conjunction with suitable shell door latching mechanisms other than the latching mechanism specifically shown in FIG. 10.

The latching mechanism in FIGS. 11 and 12 includes some features which are similar to that of FIGS. 2 and 3. Accordingly, various elements, e.g. cam portion 32, arms 34 and 36 and free ends 46 and 48 are labelled in FIGS. 11 and 12 with reference characters which correspond to reference characters of similar elements in FIGS. 2 and 3. The operation of these elements is described above with respect to FIGS. 2 and 3.

FIGS. 10, 11 and 12 show a handle 90 arranged on the interior of shell 12. Handle 24 (FIGS. 1 and 10) is arranged on the exterior of shell 12. When handle 90 is in the horizontal position shown in FIGS. 10 and 11, free ends 42 and 46 are extended to a latching position (as described above with respect to FIGS. 2 and 3). On the other hand, when handle 90 is in the vertical position shown in FIG. 12, free ends 42 and 46 are retracted to an unlatched position. Handle 24 operates in a similar manner. This type of latching mechanism is typically used in pick-up truck shells sold under the trademark BRAHMA.

When a latching mechanism of the type shown in FIGS. 10, 11 and 12 is in a latched position (FIG. 11), handle 90 is laterally displaced from at least a portion of arm 34 by a distance represented in FIG. 11 by D. To accommodate for this lateral spacing, rigid member 86*a* is provided with a means for receiving handle 90 (e.g., aperture 100 and hollow interior 98) and a means for receiving arm 34 (e.g. groove 96) which are laterally spaced from each other by the distance D. The distance D of the lateral spacing between aperture 100 and groove 96 is determined by the lateral spacing of the handle 90 and the arm of the 34 of the latching mechanism to be locked and may be made relatively large (e.g., as in FIG. 9*a*) for some latching mechanisms or relatively small (e.g., as in FIG. 9*b*) for other latching mechanisms.

The rigid member 86*a* comprises a substantially "L" shaped member having a first leg 92 and a second leg 94 which extends substantially perpendicular to first leg 92. As shown in FIGS. 9 and 10, first leg 92 includes two substantially flat end surfaces 93. A groove 96 is located between the surfaces 93. Arm 34 of latching mechanism 88 extends through groove 96 when rigid member 86*a* is placed on latching mechanism 88.

Second leg 94 has a hollow interior 98 and an aperture 100 opening into the hollow interior 98. When rigid member 86*a* is placed over latching mechanism 88, as shown in FIG. 10, handle 90 extends through aperture 100 into the hollow interior 98 of second leg 94 while arm 34 of latching mechanism 88 extends through groove 96 and while flat surfaces 93 abut against, or adjacent to, the inside facing surface of door 16. Flat surfaces 93 stabilize rigid member 86 so that rigid member 86*a* may strongly resist the twisting torque which would be applied to the rigid member if a person attempts to turn handle 24. In this manner, handle 90, as well as shaft 50, are prohibited from pivoting or rotating about the axis of shaft 50 by virtue of the connection of rigid member 86*a* with handle 90 and arm 36 in conjunction with the rigidity of rigid member 86*a*. Accordingly, latching mechanism 88 is thereby locked in a latched position. Rigid member 86*a* may be readily applied to or released from arm 34 and handle 90 from the interior of shell 12 so as to allow latching mechanism 88 to be selectively locked or unlocked from the interior of shell 12. Additionally, rigid member 86*a* may be slid along arm 34 away from handle 90 to unlock the latching mechanism.

Figure 9B:
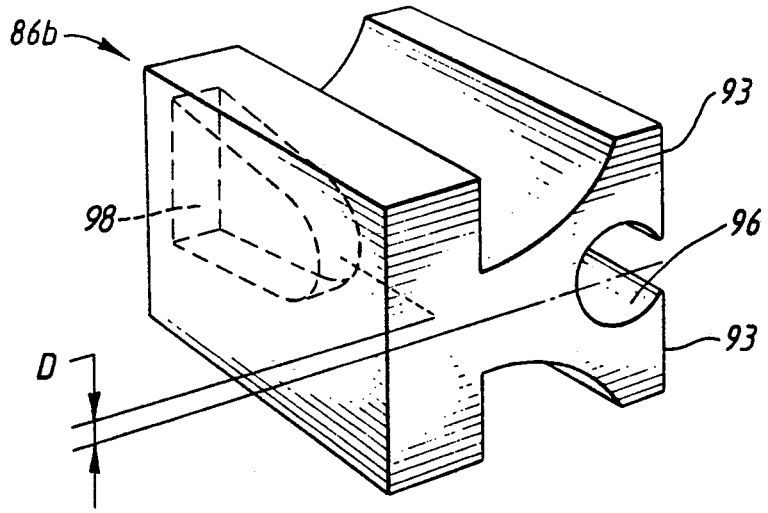
FIG. 9*b* is a perspective view of a substantially rigid member according to a fourth embodiment of the present invention.

The rigid member 86*a* of FIG. 9*a* has a substantially "L"-shaped configuration as discussed above. However, other suitable configurations may also be employed. For example, another preferred configuration is the substantially "T"-shaped configuration of rigid member 86*b* shown in FIG. 9*b*. Like elements in FIGS. 9*a* and 9*b* are labeled accordingly.

Figure 13:
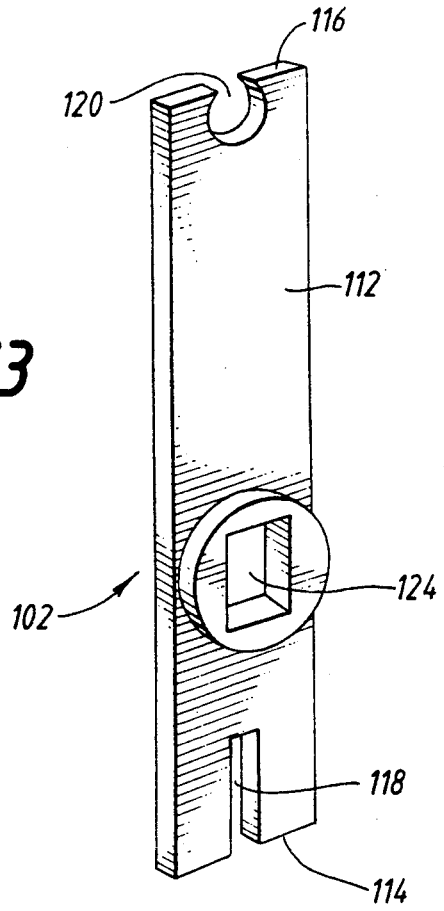
FIG. 13 is a perspective view of a substantially rigid member according to a fifth embodiment of the present invention.
Figure 14:
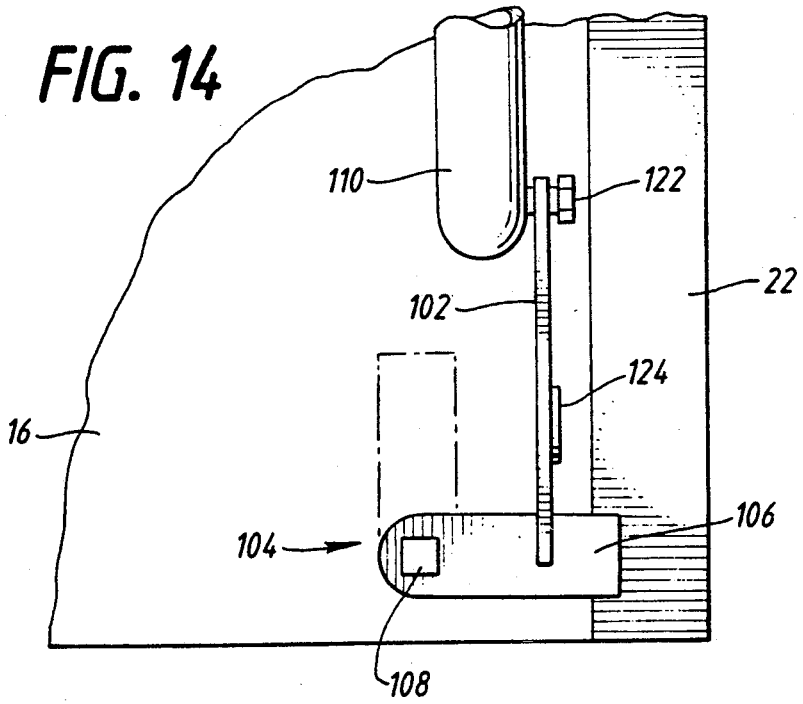
FIG. 14 is a perspective view of the substantially rigid member shown in FIG. 13 as applied to another type of latch mechanism commonly used on existing pick-up truck bed shells.
Figure 15:
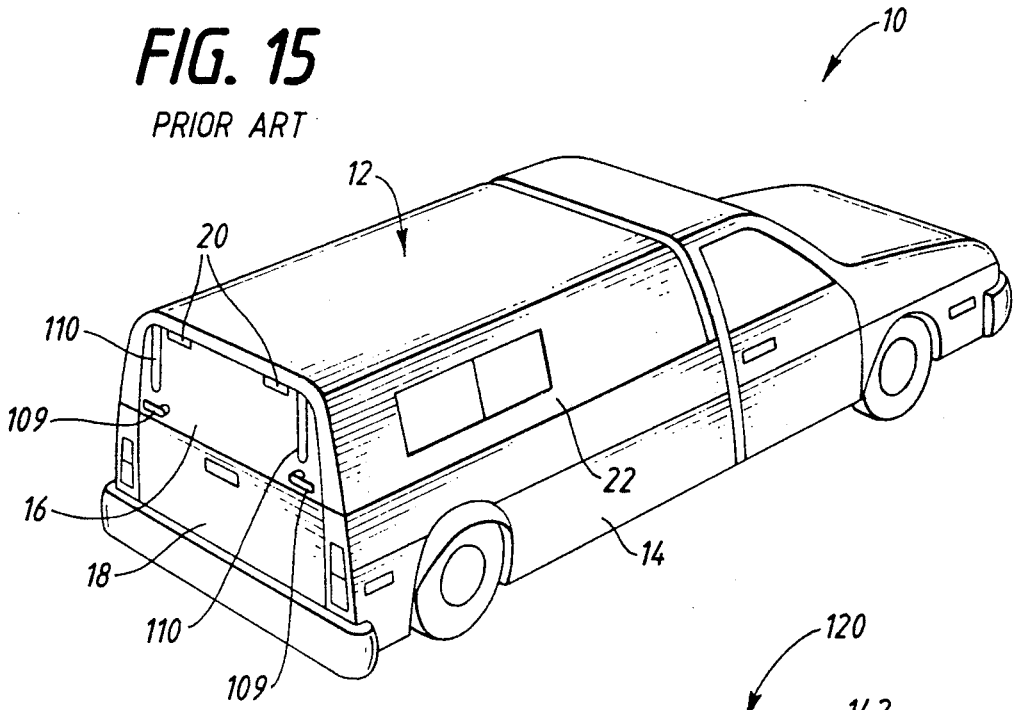
FIG. 15 PRIOR ART
FIG. 15 is a perspective view of a conventional pick-up truck and another conventional pick-up truck shell arranged over the bed of the pick-up truck.

Fifth Embodiment:

FIG. 13 shows a substantially rigid member 102 according to a fifth embodiment of the present invention operable with a shell door latching mechanism 104 of the type shown in FIGS. 14 and 15. However, it will be understood that the fifth embodiment may be used in conjunction with suitable shell door latching mechanisms other than the latching mechanism specifically shown in FIG. 14.

The latching mechanism 104 shown in FIG. 14 comprises a pivotable plate 106 extending from a shaft 108. Plate 106 is pivotable about the axis of shaft 108 between the solid and broken line positions shown in FIG. 14. In the position shown in solid lines in FIG. 14, plate 106 abuts a portion of the main body 22 of shell 12 and prohibits shell door 16 from opening (moving in the direction into the page of FIG. 14). When moved to the vertical position shown in broken lines in FIG. 14, plate 106 allows the door of the shell to be opened. Typically, a pivotable handle (109 in FIG. 15) on the exterior of shell 12 is connected to shaft 108 to allow a user to rotate the shaft and, thereby, pivot plate 106 between the solid and broken line positions shown in FIG. 14 from outside of shell 12. However, as shown in FIG. 14 and as discussed below, rigid member 102 can be readily placed in a position which prohibits the movement of pivotable plate 106 into the vertical position.

In a typical arrangement, a latching mechanism 104 is provided adjacent each of the lower two corners of the shell door. In those shells which have pneumatic strut devices for automatically opening the door when the door is unlatched, each latching mechanism 104 is typically located below and spaced from the lower end of a mounted strut 110.

Referring to FIG. 13, rigid member 102 is composed of a plate-like member 112 having a first end 114 and a second end 116. A first slot 118 extends from first end 114 along a portion of the length of member 112. A second rounded slot 120 extends from second end 116 in member 112.

In order to lock pivotable plate 106 in a latched position (the solid line position in FIG. 14), pivotable plate 106 is fitted into first slot 118 while a bolt 122 fixed to the shell or to pick-up truck is fitted into second slot 120. In FIG. 14, bolt 122 is a mounting bolt extending from the lower end portion of a conventional pneumatic strut assembly. When arranged as shown in FIG. 14, rigid member 102 prohibits pivotable plate 106 from pivoting to an unlatched position (the broken line position) by forming a rigid beam between pivotable plate 106 and bolt 122.

As discussed above, pivotable plate 106 is connected, through shaft 108, to a handle located on the outside of the shell. However, in many shell latching mechanisms, shaft 108 is not provided with a handle for moving pivotable plate 106 from the interior of the shell. Accordingly, in an embodiment of the present invention, plate-like member 112 is provided with an aperture 124 configured to fit about the end of shaft 108 from the interior of shell 12. When so fitted, rigid member 102 can operate as a handle which can be used to rotate pivotable plate 106 from the interior of the shell.

Each of the above discussed embodiments relate to methods and devices for locking the door or flap of a typical pick-up truck shell closed from the interior of the shell. Each of the above discussed embodiments employ a substantially rigid member which is selectively secured to moving parts of the existing latch mechanism to prohibit such moving parts from moving and, to, thereby, selectively prohibit the latch mechanism from unlatching or unlocking the door or flap of the shell. In order to lock the shell door or flap, the substantially rigid member is abutted against and secured to moving parts of the latch mechanism from the interior of the shell. In this manner, a person inside of the shell and pick-up bed may secure the flap or door in a closed position and prohibit the flap or door from being opened by prohibiting movement of the moving parts of the latch mechanism. Embodiments of the substantially rigid member are provided with means by which the rigid member can be used as a handle for selectively latching and unlatching a conventional shell door latching mechanism from the interior of the shell. The present invention provides substantial safety as well as security benefits by allowing a person inside of a conventional pick-up truck shell to latch and unlatch the shell door as well as to selectively lock and unlock the shell door in a latched position from the interior of the shell.

Figure 16:
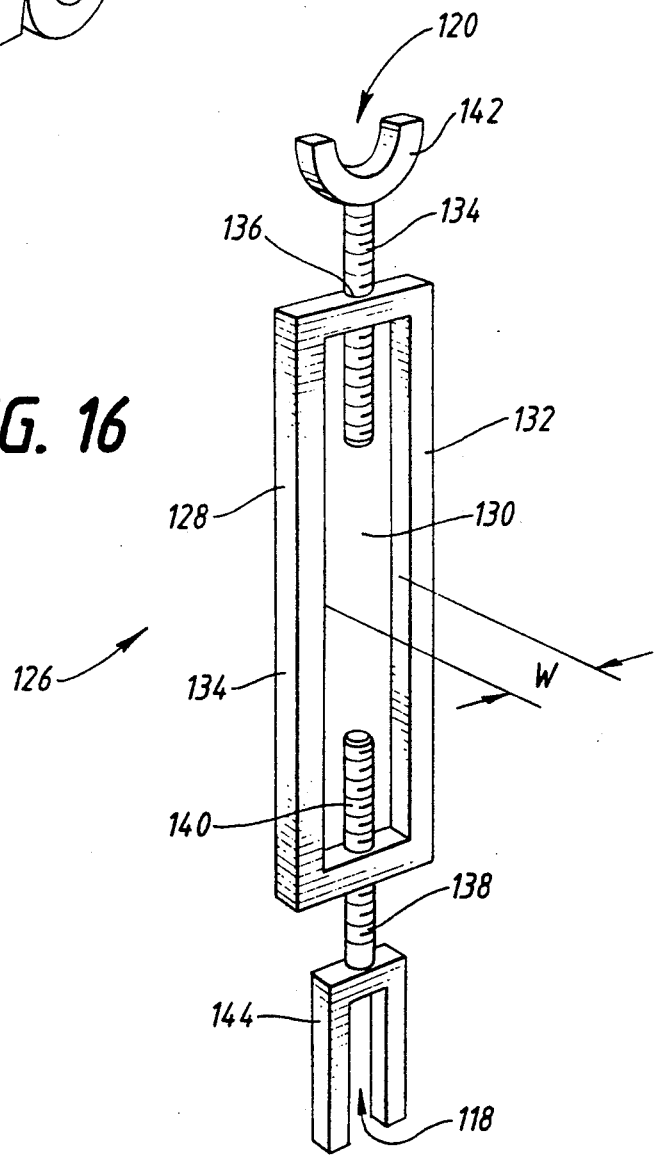
FIG. 16 is a perspective view of a substantially rigid member according to a sixth embodiment of the present invention.

Sixth Embodiment:

FIG. 16 shows a substantially rigid member 126 according to a sixth embodiment of the present invention. Rigid member 126 is operable with a shell door latching mechanism 104 of the type shown in FIGS. 14 and 15, similar to the manner in which rigid member 102 of FIG. 13 operates, as described above. That is, rigid number 126 defines a first slot 118 and a second rounded slot 120 which function similar to the first slot 118 and rounded slot 120 discussed above with respect to rigid member 102 of FIG. 13. However, the distance between first slot 118 and second slot 120 of rigid member 126 is adjustable in order to accommodate various distances between bolt 122 and plate 106 of various shell door and latching mechanism designs. Thus, rigid member 126 of FIG. 16 is adjustable for use with various shells.

Rigid member 126 comprises a hollow, rectangular body 128 defining a hollow interior 130. Rectangular body 128 shown in FIG. 16 includes two vertical legs 132 and 134 which are spaced apart by a width W. Preferably, width W is equal to or only slightly larger than the width of the square cross section of shaft 108 (FIG. 14). As a result, rigid member 126 may be used as a handle to turn shaft 108 and plate 106 from the interior of the shell. This is accomplished by inserting the portion of shaft 108 which extends into the interior of the shell through the hollow interior 130 of rigid member 126. Rigid member 126 can, thereby, be rotated to rotate shaft 108 and plate 106.

A first threaded member 134 is threaded into a threaded aperture 136 provided in the upper side (with respect to FIG. 16) of body 128. A second threaded member 138 is threaded into a threaded aperture 140 provided in the lower side (with respect to FIG. 16) of body 128. First threaded member 134 has a U-shaped free end 142 which defines a rounded slot 120. Rounded slot 120 is configured to receive a bolt 122 in a manner similar to the manner in which slot 120 of rigid member 102 in FIG. 13 receives bolt 122. Second threaded member 138 also has a U-shaped free end 144 which defines a slot 118 adapted to receive plate 106 similar to the manner in which slot 118 of rigid member 102 in FIG. 13 receives plate 106. By virtue of the threaded connection between each of the threaded members 134 and 138 and the body 128, the distance between slots 118 and 120 is adjustable between a minimum distance and a maximum distance. The minimum and maximum distances depend upon the longitudinal length of rectangular body 128, the length of the threaded portion of threaded members 134 and 138 and the longitudinal length of the free ends 142 and 144 of the threaded members 134 and 138, respectively.

While the above description refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A device for locking the door of a pick-up truck shell of the type having a pneumatic strut mounted to the shell door by strut mounting structure and a door latching mechanism provided with a pivotable plate pivotably movable between a latched position and an unlatched position, the device comprising:

a substantially rigid member;

means for connecting the substantially rigid member to the pivotable plate upon the pivotable plate being in the latched position; and means for connecting the substantially rigid member to at least one of the pneumatic strut and the strut mounting structure simultaneously with the connection of the substantially rigid member to the pivotable plate;

wherein, upon connecting to the pivotable plate and to at least one of the pneumatic strut and the strut mounting structure, the substantially rigid member prohibits movement of the pivotable plate from the latched position to the unlatched position.

2. A device for locking the door of a pick-up truck shell of the type having a pneumatic strut mounted to the shell door by strut mounting structure and a door latching mechanism provided with a pivotable plate pivotably movable between a latched position and an unlatched position, the device comprising a substantially rigid member having:

a first connector for connecting to the pivotable plate upon the pivotable plate being in the latched position;

a second connector for connecting to at least one of the pneumatic strut and the strut mounting structure; and a substantially rigid portion extending from the first connector to the second connector;

wherein upon connecting the first connector to the pivotable plate and the second connector to at least one of the pneumatic strut and the strut mounting structure, the substantially rigid portion prohibits movement of the pivotable plate from the latched position to the unlatched position.

3. A device as claimed in claim 2, wherein:

the substantially rigid member has a first end and a second end;

the first connector comprises a first slot provided in the first end of the substantially rigid member and configured to receive the pivotable plate therein upon the pivotable plate being in the latched position;

the second connector comprises a second slot provided in the second end of the substantially rigid member and configured to receive a portion of at least one of the pneumatic strut and the strut mounting structure.

4. A device as claimed in claim 3, wherein:

the latching mechanism further includes a shaft connected to the pivotable plate and having an axis about which the plate is pivotable, the shaft having an end portion extending from the plate into the interior of the shell;

the substantially rigid member defines an aperture shaped to receive the end portion of the shaft; and the substantially rigid member defines a handle for pivoting the plate from the interior of the shell upon passing the end portion of the shaft through the aperture.

5. A device as claimed in claim 2, further comprising means for adjusting the distance between the first and second connectors.

6. A device as claimed in claim 2, wherein the first connector comprises a first threaded member having a free end and an opposite end threadably secured into the substantially rigid portion and the second threaded member having a free end and an opposite end threadably secured into the substantially rigid portion, whereby the distance between the free ends of the first and second threaded members is adjustable by adjusting the degree to which at least one of the first and second threaded member is threaded into the substantially rigid portion.

7. A method for locking the door of a pick-up truck shell of the type having a pneumatic strut mounted to the shell door by strut mounting structure and a door latching mechanism provided with a pivotable plate pivotably movable between a latched position and an unlatched position, the method comprising the steps of:

connecting a substantially rigid member to the pivotable plate upon the pivotable plate being in the latched position; and connecting the substantially rigid member to at least one of the pneumatic strut and the strut mounting structure simultaneously with the connection of the substantially rigid member to the pivotable plate;

wherein, upon connecting to the pivotable plate and to at least one of the pneumatic strut and the strut mounting structure, the substantially rigid member prohibits movement of the pivotable plate from the latched position to the unlatched position.

* * * * *